United States Patent [19]

Frank et al.

[11] Patent Number: 4,941,684

[45] Date of Patent: Jul. 17, 1990

[54] AUTOMATIC BOOK MARK

[75] Inventors: Amos Frank; Joel Kehat, both of Haifa, Israel

[73] Assignee: Joseph D. Ben-Dak, Kiryat, Israel

[21] Appl. No.: 232,176

[22] Filed: Aug. 15, 1988

[51] Int. Cl.[5] ..... B42D 9/00

[52] U.S. Cl. ..... 281/42; 116/237; 116/239; 281/51

[58] Field of Search ..... 116/239, 234, 237; 281/51, 42; 24/67.1, 543, 562, 563

[56] References Cited

U.S. PATENT DOCUMENTS

| | | | |
|---|---|---|---|
| 2,194,576 | 3/1940 | Truesdale | 116/234 |
| 2,436,609 | 2/1948 | Salfier | 116/239 |
| 2,478,376 | 8/1949 | Swart | 24/67.9 |
| 3,158,131 | 11/1964 | Salayka | 116/239 |
| 4,437,685 | 3/1984 | Valencia | 116/234 |
| 4,778,201 | 10/1988 | Kouno | 281/42 |
| 4,793,632 | 12/1988 | Hoffman | 281/42 |

*Primary Examiner*—Frank T. Yost
*Assistant Examiner*—Tom Hamill, Jr.
*Attorney, Agent, or Firm*—Sherman and Shalloway

[57] ABSTRACT

A book mark for use in combination with a book having a front cover, a back cover and a spine therebetween, comprises a clamp for releasable attachment to the book and a marker, integrally formed with the clamp and arranged to extend, in use, from the clamp generally outward of the spine of the book, for releasably marking a page in the book. The clamp and the marker are formed of a molded, flexible, resilient material.

16 Claims, 6 Drawing Sheets

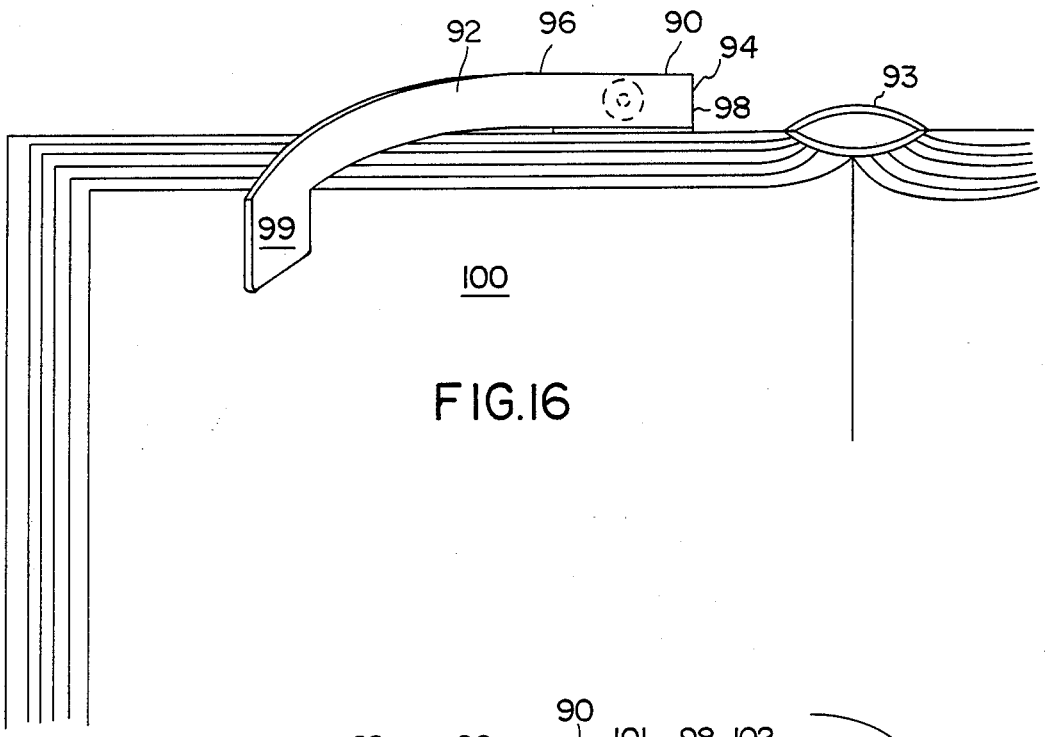
FIG.16
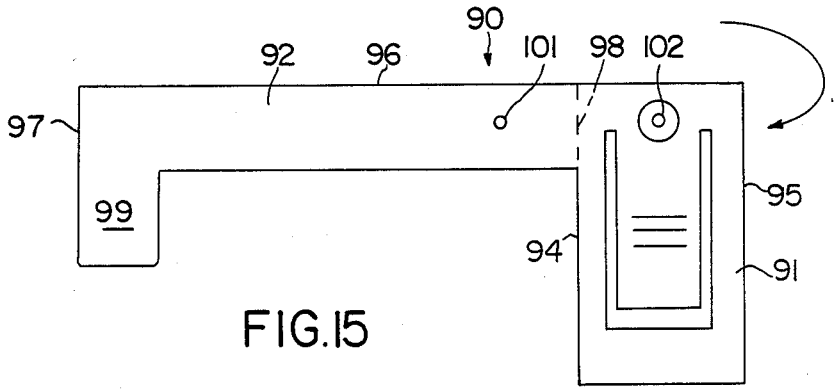
FIG.15
FIG.14
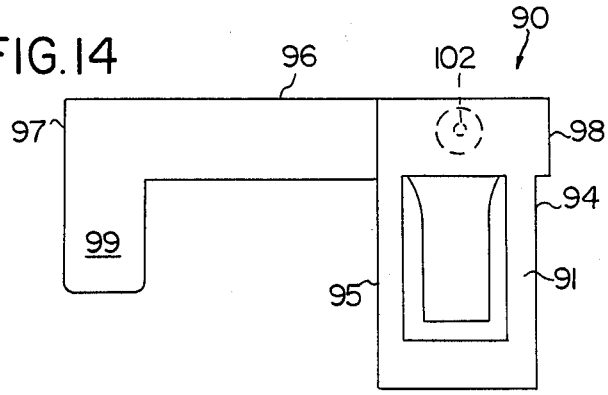

AUTOMATIC BOOK MARK

BACKGROUND OF THE INVENTION

1. Field of the Invention

The present invention is directed to an automatic book mark. More particularly, the present invention is directed to a book mark whereby once set in place the reader's place is automatically maintained without further adjustment.

2. Description of the Prior Art

U.S. Pat. No. 4,024,832, to Machnikowski, discloses a book mark comprising a first section adapted to extend along one side of a page or leaf of a book or the like, a tongue extending from the first section and adapted to extend on the other side of the page or leaf and cooperating with the first section to hold the marker to the page or leaf with a wedging action; and a flexible second section which is adapted to extend from the first section and the page or leaf. The first and/or second section may carry printed or written messages The relative flexibility of the second section permits the book mark to bend should the marker be forced toward the book, as if dropped, so that the pages of the book are not damaged U.S. Pat. No. 901,225, to Brockett et al., discloses a book mark comprising a clasp or clip for attachment to the back of a book; a rod-member pivotally attached to the clasp or clip; and a reference slip or card, insertable between pages of the book, pivotally connected to the rod-member.

U.S. Pat. No. 1,790,649, to Baumgarten, discloses a book mark comprising a clip and a band of soft, flexible material secured to the clip at one end, the other end of the band being weighted so that it will remain in place on the page which it overlies.

U.S. Pat. No. 2,664,847, to Orman, discloses a book mark comprising a plurality of lengthy flexible marker ribbons and a clamp for attaching corresponding ends of the respective ribbons to one of the book covers.

U.S. Pat. No. 3,059,609, to Sealana, discloses a book mark having a plurality of finders which enable convenient location of several places in a book. The book mark comprises a substantially flat wafer member having a linear slot therein; a tab member substantially integrally connected to the wafer and extending outwardly therefrom in the same plane; a hook portion connected to the extended end of the tab member projecting back towards the slot in confronting relation with the tab member; and a plurality of thin ribbons each looped at one end through the slot and fastened to its own body portion whereby the ribbon is secured to the wafer member. Each of the ribbons has a width substantially equal to the length of the slot whereby the ribbons are disposed in superposed aligned relationship and each of the ribbons has a length substantially in excess of the height of the book in which the marker is used.

U.S. Pat. No. 2,405,374, to Singer, Jr., discloses a book mark comprising a leaf having a folding line and two parts turnable relative to each other around said folding line, and a resiliently bendable flap having a part permanently and closely affixed to a part of the surface of said leaf and having another part extending in the direction to said folding line and forming a continuously resilient continuation of the affixed part without any foldably weakening lines whereby the flap, in unbent condition, is positioned parallel to the leaf and, in bent condition, tends to return to the parallel position, the folding line being located beyond the free end of the flap.

U.S. Pat. No. 2,436,609, to Safier, discloses a book mark comprising a clip having a support plate disposed at right angles thereto, a first sleeve slidingly mounted on the plate, and a second sleeve slidingly mounted on the first sleeve. A marking finger is pivotally attached to and suspended from the second sleeve. The telescoping action of the first and second sleeves over one another and the support plate allow positioning of the marking finger at a desired location.

U.S. Pat. No. 3,016,036, to Jorgensen, discloses a place-holding device for books comprising a supporting member adapted to be positioned along the spine of a book, and provided with clips to engage the book so as to secure the supporting member in place thereon. A pair of arms is provided at one end of the supporting member, the arms adapted to extend along the edges of respective opposite pages of the book. The arms are rotatably mounted on the supporting member so as to be adjustable to different degrees of opening of the book. The arms are frictionally inhibited from rotating relative to one another so that they can hold a given adjustment. A pair of place-holding fingers disposed on respective arms are adapted to extend across portions of the faces of opposite pages to restrain accidental closure of the book and to mark the place upon intentional closure of the book.

U.S. Pat. No. 1,646,291, to Horacek, discloses a book mark comprising a single length of wire bent intermediate its ends to provide a tongue; one side portion of the tongue bent centrally at right angles to form a laterally extending arm, the outer end portion of the arm bent at right angles to the arm to provide a depending page-engaging finger, the extreme end of the finger bent upon itself to form a rounded loop; the opposite side portion of the tongue bent upon itself to extend downwardly at a point parallel with the arm and by a plurality of successive bends formed into a substantially frusto-conical clip, the clip depending from the free end of the tongue adjacent thereto, the free end of the opposite side portion terminating in a depending portion parallel with and adjacent the opposite side portion of the tongue, the extreme end thereof bent at right angles to overlap the opposite side portion of the tongue, to impart a torsional tension to the arm and finger; with a tie plate secured to and intermediate the side portions comprising the tongue to maintain the side portions in spaced parallel relation. In an alternative embodiment, a similar structure is formed from sheet metal.

U.S. Pat. No. 1,937,442, to Scognamillo, discloses a book mark comprising a clip adapted to straddle one of the covers of a book, an arm pivotally mounted on the clip to extend substantially parallel to and obliquely of the upper edges of the pages of the book and a finger flexibly connected to the arm to overlie a leaf or page of the book. The finger, on account of its flexible connection to the arm, may be caused, by the turning of the leaf or page which it overlies, to swing out of overlying relation to the page and then be caused, by its weight and its flexible connection to the arm, to swing back into position to overlie the next succeeding leaf or page of the book.

U.S. Pat. No. 2,449,211, to Forsyth, discloses a book mark comprising a clamp, substantially U-shaped in cross section, formed from a flat piece of sheet material bent longitudinally upon itself to provide outer and inner clamp sections adapted to engage between them a book cover, the bend connecting the sections straddling the upper edge of the cover; a tubular shoulder, non-circular in cross-section, on the clamp, an end edge of one of the clamp sections being rolled to provide the shoulder, the shoulder being disposed wholly beyond and adapted to fit against the side edge of the cover, to constitute a guide and stop for accurate positioning, in cooperation with the bend of the clamp, of the marker upon the cover; a marker arm of spring wire having one end extended into the shoulder and bent so as to be griped within the shoulder and held against movement therein, the arm including a long straight medial portion extended from the shoulder at a right angle thereto and outside of and in parallel relation to the bend of the clamp, the medial portion terminating in a free end inwardly extended to lie against leaves of the book and to move therebetween when the leaves are turned.

U.S. Pat. No. 2,610,074, to Meyers, discloses a book mark comprising a resilient clip; a circular plate struck from the clip and extending obtusely therefrom; a lever having a cup-shaped circular housing fixed to one end thereof; the circular housing pivotally secured to the circular plate; a page holding member extending right angularly from the other end of the lever; and a coil spring in the housing secured at one end to the housing and at the other end to the plate for constantly urging the lever downwardly to a page-holding position.

U.S. Pat. No. 3,158,131, to Salayka, discloses a book mark comprising an elongated arm; means provided on one end of the arm for attachment to a cover of a book adjacent the binding thereof with the arm overlying and generally parallel to one edge of the pages of the book; and a tab on the other end of the arm adapted to lie between two consecutive pages of the book, the tab extending toward the arm-attaching means at an acute angle with respect to the length of the arm. The arm and tab of the book mark are made of an integral sheet of elastic, plastic material which is sufficiently stiff to be self-sustaining when the book mark is held supported from the end of the arm bearing the arm-attaching means with the arm horizontal while being sufficiently soft and resilient for the arm to be bent away from the edge of the page of the book which it confronts and to be twisted about its longitudinal axis as the page engaged by the tab is turned in a normal manner, thereby permitting escape of the page past the tab and the tab and arm resuming their relaxed shape with the tab overlying the edge of the next page of the book.

U.S. Pat. No. 3,159,137, to Baldwin, discloses a book mark comprising an elongate clip consisting of an outside frame and a central tongue formed integrally therewith and jointed with the outside frame at one end of the clip; and a resilient tongue portion of transparent material, said resilient tongue portion being of arcuate shape and joined with the clip at the one end thereof. The resilient tongue initially extends laterally away from the one end of the clip in arcuate overlying relation thereto to terminate at its free end in closely spaced relation to the clip adjacent the opposite end of the clip. The resilient tongue is of uniform width throughout its length, the width being substantially equal to that of the clip, and is of a thickness substantially less than the thickness of the clip so as to be readily movable both sideways and away from the clip so as to provide substantially no impedance to the turning of a page upon which the tongue may rest. The resilient tongue is, at the same time, of sufficient resiliency to permit the tongue to return toward the clip after each deflection which may be incidental to the turning of a page.

U.S. Pat. No. 3,381,654, to Hupp et al., discloses a one-piece bookmark made of a plane strip of flexible, resilient material having a clip portion spaced from one end with a holding tongue in the plane of the strip to clip the bookmark to pages of a book and an indicator portion with a page indicating marking tongue at the end of the strip with the free end of the page indicating tongue extending over the clip portion so that the end of the page indicating tongue will overlie pages of the book. The tongues are formed from the plane of the strip by slitting the strip with the ends of the slits curved to distribute the stress of flexing and bending the tongues and to provide space for pages held by the holding tongue. The material adjacent the end of the slit in the clip portion is deflected from the plane of the strip to provide greater gripping effect of the clip portion. The clip portion and indicator portion may be joined along a bend or crease in the strip to form an angle between the portions so the page indicating tongue may overlie more pages.

U.S. Pat. No. 4,487,156, to Frost, discloses a book mark comprising an anchoring member for securing the book mark to the body of a book and a pointer connected to the anchoring member and adapted, in use, to overlie an edge portion of pages of the book, and to extend from the anchoring member generally in the direction of a center portion of the spine of the book. The arrangement being such that the pointer is capable, in use, of flexing outwardly of the pages of the book on the turning of a page to allow passage of the page past the pointer.

German Patent No. 2931263 discloses a book mark comprising a clip section and an indicating section. The clip section includes an elastic arm extending therefrom and the marking section also includes an elastic arm extending therefrom. The two elastic arms are joined so as to form a telescopic joint.

German Patent No. 3245173 discloses a transparent marker that is utilized for marking a line or a paragraph on a given page, by clipping to one or more pages of a book.

German Patent No. 3529851 discloses a book mark which affixes to the book by utilization of a sticky substance, which must be periodically replenished.

SUMMARY OF THE INVENTION

It is an object of the invention to provide a simple and reliable book mark which is easy and economical to manufacture.

This and other objects of the invention, as will become apparent hereinafter, has been achieved by the provision of, in a first embodiment, a book mark for use in combination with a book having a front cover, a back cover and a spine therebetween, said book mark comprising:

a clamp means for releasable attachment to said book;

a marker means, integrally formed with said clamp means and arranged to extend in use from said clamp means generally outward of said spine, for releasably marking a page in said book;

said clamp means and said marker means formed of a molded flexible, resilient material;

wherein said clamp means is a substantially U-shaped member, having a first substantially vertical edge and a second substantially vertical edge, comprising:

a first plate-like member forming one of the legs of the U, said first plate-like member having a first end, a second end, a first face and a second face, said second face of said first plate-like member contactingly engageable of said book;

a second plate-like member forming the other of the legs of the U, said second plate-like member having a first end, a second end, a first face and a second face, said second face of said second plate-like member contactingly engageable of said book;

joining means for conjoining said second end of said first plate-like member with said second end of said second plate-like member so that said second face of said first plate-like member faces and is disposed substantially parallel to said second face of said second plate-like member for resiliently engaging a portion of said book therebetween;

and wherein said marker means comprises:

an arm member extending substantially horizontally from said first vertical edge of said U-shaped member proximate said joining member, said arm member having an outboard end remote from said U-shaped member;

a marker member extending substantially vertically downwardly from said arm member, said marker member contactingly engageable of a page of said book;

and wherein said U-shaped member, said arm member and said marker member cooperate so that, when said U-shaped member engages a portion of said book, with said second vertical edge proximate said spine of said book, and said marker member engages a page of said book, said arm member yieldably urges said marker member into engagement with said page of said book.

There is also provided, in a second embodiment, a book mark for use in combination with a book having a front cover, a back cover and a spine therebetween, said book mark comprising:

a clamp means for releasable attachment to said book;

a marker means, integrally formed with said clamp means and arranged to extend in use from said clamp means generally outward of said spine, for releasably marking a page in said book;

said clamp means and said marker means formed of a flexible, resilient material;

wherein said clamp means is a substantially U-shaped member, having a first substantially vertical edge and a second substantially vertical edge, comprising:

a substantially vertical first plate-like member forming one of the legs of the U, said first plate-like member having a first end, a second end, a first face and a second face, said second face of said first plate-like member contacting engageable of said book, said first plate-like member having a first flange portion extending substantially horizontally outward from said second face proximate said second end, said first flange portion having an outboard end, a second flange portion extending substantially vertically downward from said outboard end of said first flange portion, said second flange portion substantially parallel to said first plate-like member, said second flange portion having an expanded outer edge of predetermined geometric shape;

a substantially vertical second plate-like member forming the other of the legs of the U, said second plate-like member having a first end, a second end, a first face and a second face, said second face of said second plate-like member contactingly engageable of said book; said second plate-like member having a third flange portion extending substantially horizontally outward from said first face proximate said second end, said third flange portion having an upper face, a bore passing through said third flange portion substantially parallel to said second plate-like member, said bore having a predetermined geometric shape adapted to receive and slidingly engage said expanded outer edge of said second flange portion, a slit formed in said third flange portion and coextensive therewith communicating said upper face of said third flange portion with said bore, said slit adapted to receive and slidingly engage said second flange portion;

said first flange portion, said second flange portion, said third flange portion, said bore and said slit cooperating to interconnect said first plate-like member and said second plate-like member so that said second face of said first plate-like member faces and is disposed substantially parallel to said second face of said second plate-like member for resiliently engaging a portion of said book therebetween;

and wherein said marker means comprises:

an arm member extending substantially horizontally from said first vertical edge of said U-shaped member proximate said first flange portion, said arm member having an outboard end remote from said U-shape member;

a marker member extending substantially vertically downward from said arm member, said marker member contactingly engageable of a page of said book;

and wherein said U-shaped member, said arm member and said marker member cooperate so that, when said U-shaped member engages a portion of said book, with said second vertical edge proximate said spine of said book, and said marker member engages a page of said book, said arm member yieldably urges said marker member into engagement with said page of said book.

There is also provided, in a third embodiment, a book mark for use in combination with a book having a front cover, a rear cover and a spine, said book mark comprising:

a clamp means for releasable attachment to said book;

a marker means, operatively connected to said clamp means for releasably simultaneously marking a plurality of pages in said book;

said clamp means formed of a flexible, resilient material;

wherein said clamp means is a substantially U-shaped member comprising:

a substantially vertical first plate-like member forming one of the legs of the U, said first plate-like member having a first end, a second end, a first face and a second face, said second face of said first plate-like member contactingly engageable of said book;

a substantially vertical second plate-like member forming the other of the legs of the U, said second plate-like member having a first end, a second end, a first face and a second face, said second face of said second plate-like member contactingly engageable of said book;

joining means for conjoining said second end of said first plate-like member with said second end of said second plate-like member so that said second face of said first plate-like member faces and is disposed substantially parallel to said second face of said second plate-like member for resiliently engaging a portion of said book therebetween;

and wherein said marker means comprises:

a plurality of markers pivotally connected to said clamp means for rotation about respective vertical axes, each of said markers comprising:

a substantially horizontal arm member having a first end and a second end, said first end pivotally connected to said clamp means for rotation about a vertical axis, and a marker member extending substantially vertically downward from said second end of said arm member, said marker member being receivable between adjacent pages of said book to mark a page.

There is also provided in a fourth embodiment, a book mark for use in combination with a book having a front cover, a back cover and a spine therebetween, said book mark comprising:

a clamp means for releasable attachment to said book;

a marker means, integrally formed with said clamp means and arranged to extend, in use, from said clamp means generally outward of said spine, for releasably marking a page in said book;

said clamp means and said marker means formed of a molded, flexible, resilient material;

wherein said clamp means is a substantially U-shaped member, having a first substantially vertical edge and a second substantially vertical edge;

and wherein said marker means comprises:

an arm member hingedly attached to and extending substantially horizontally from said first vertical edge of said U-shaped member, said arm member having an outboard end remote from said U-shaped member, said arm member hingedly movable from a first position wherein it extends substantially in a common plane with said U-shaped member to a second position wherein it is substantially folded across said U-shaped member, a marker member fixed to said outboard end of said arm member and extending substantially vertically downwardly from said arm member, said marker member contactingly engageable of a page of said book;

releasable locking means for releasably locking said arm member in said second position;

wherein said U-shaped member, said arm member, said marker member and said releasable locking means cooperate so that, when said arm member is locked in said second position and said U-shaped member engages a portion of said book, with said first vertical edge proximate said spine of said book, and said marker member engages a page of said book, said arm member yieldably urges said marker member into engagement with said page of said book, and when said arm member is released from said second position and said U-shaped member engages a portion of said book, with said first vertical edge proximate said spine of said book, and said marker member engages a page of said book, said arm member may freely move between said first and second positions to allow browsing through the pages of said book while said marker member remains in contact with said page.

BRIEF DESCRIPTION OF THE DRAWING

Figures

FIG. 14 is a plan view of a book mark according to a fourth embodiment of the present invention, "locked" in a second position.

FIG. 15 is a plan view of a book mark according to a fourth embodiment of the present invention, in a first position.

FIG. 16 is a front view of a book mark according to a fourth embodiment of the present invention, "locked" in a second position, in place on a book.

DETAILED DESCRIPTION OF THE INVENTION

Figure 1:
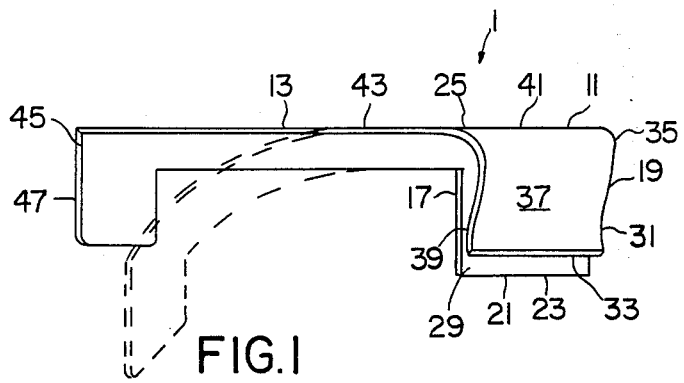
FIG. 1 is a perspective view of a book mark according to a first embodiment of the present invention.
Figure 2:
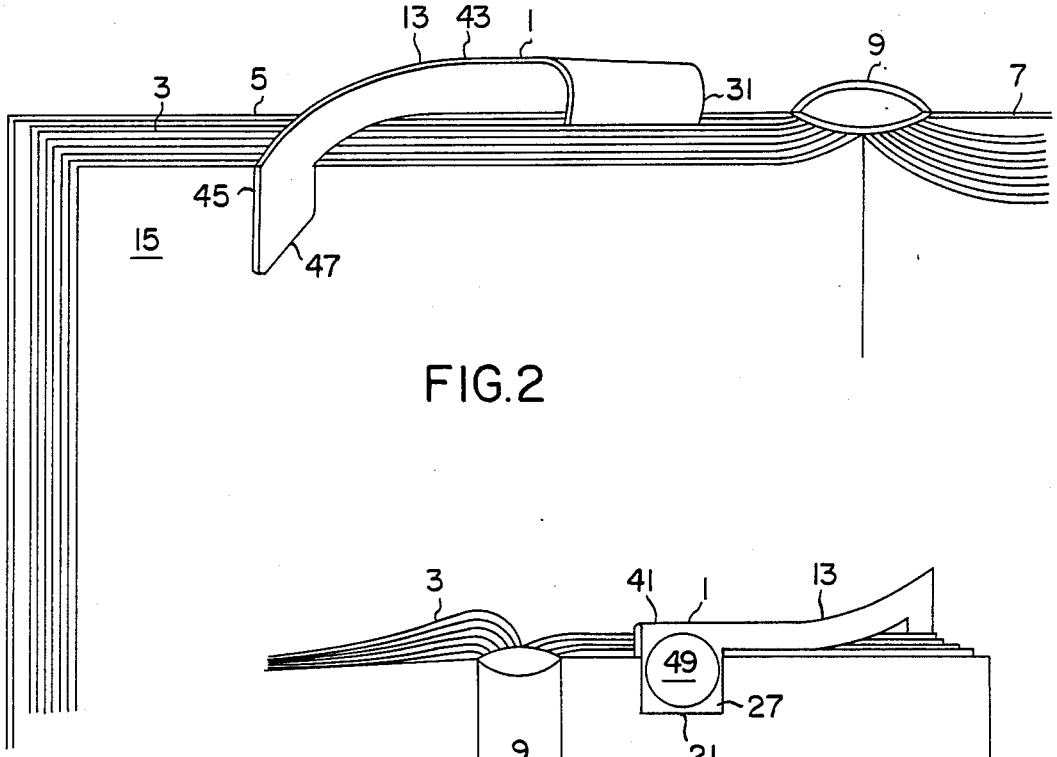
FIG. 2 is a front view of a book mark according to a first embodiment of the present invention in place on a book.
Figure 3:
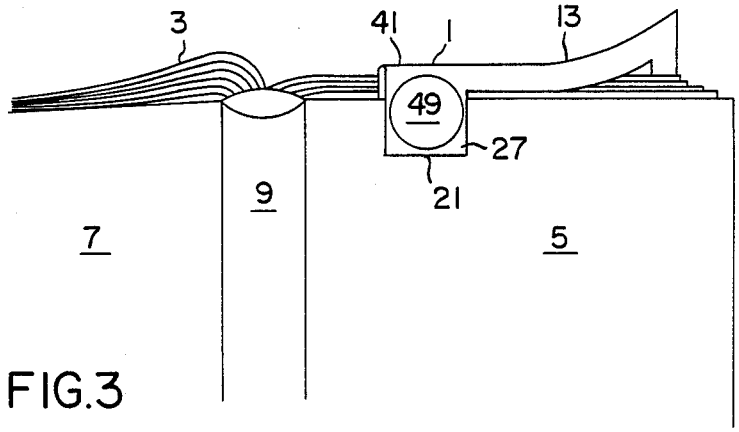
FIG. 3 is a rear view of a book mark according to a first embodiment of the present invention in place on a book.

Turning now to FIGS. 1–3, there is illustrated a book mark according to a first embodiment of the present invention. The book mark, generally indicated at 1, is designed for use in combination with a book 3 having a front cover 5, a back cover 7 and a spine 9. The book mark comprises a clamp 11 for releasable attachment to the book, as by clamping one of the front or back covers therein; and a marker 13 which is integrally formed with the clamp and arranged to extend, in use, from the clamp generally outward of the spine of the book. The marker 13 releasably marks a page 15 in the book 3. The clamp 11 and the marker 13 are formed of a molded, flexible, resilient material, e.g. a plastic having sufficient flexibility and resilience so as to allow the clamp to function by resiliently engaging the back cover or pages of a book therein and to allow sufficient resilience and flexibility of the marker so as to hold the marker in place against a page and allow the marker to be flexed to allow movement of pages thereunder. Suitable plastic materials include the acetal resins, such as Delrin ® (E. I. Du Pont de Nemour and Company).

The clamp 11 is a substantially U-shaped member having a first substantially vertical edge 17 and a second substantially vertical edge 19. The clamp comprises a first plate-like member 21 forming one of the legs of the U. The first plate-like member 21 has a first end 23, a second end 25, a first face 27 and a second face 29, the second face 29 is contactable with the book; a second plate-like member 31 forming the other of the legs of the U, the second plate-like member 31 having a first end 33, a second end 35, a first face 37 and a second face 39, the second face 39 being contactable with the book; and a joining member 41 for conjoining the second end 25 of the first plate-like member 21 with the second end 35 of the second plate-like member 31 so that the second face 29 of the first plate-like member 21 faces and is disposed substantially parallel to the second face 39 of the second plate-like member 31 for resiliently engaging a portion of the book therebetween.

The marker 13 comprises an arm member 43 extending substantially horizontally from the first vertical edge 17 of the U-shaped clamp 11 proximate the joining member 41, the arm having an outboard end 45 remote from the U-shaped clamp; and a marker member 47 extending substantially vertically downward from the arm member 43, the marker member being contactable with a page 15 of the book 3.

In use, the U-shaped clamp 11, the arm member 43 and the marker member 47 cooperate so that, when the U-shaped clamp engages a portion of the book, with the second vertical edge 19 proximate the spine 9 of the book 3, and the marker member 47 engages a page 15 of the book 3, the arm member 13 yieldably urges the marker member 47 into engagement with the page 15 of the book 3.

As may best be seen in FIG. 3, the first face 27 of the first plate-like member 21 may be adapted to receive written indicia 49 thereon. In a similar manner, the first face 37 of the second plate-like member 31 may also be adapted to receive written indicia thereon.

The second face 29 of the first plate-like member 21 and the second face 39 of the second plate-like member may also be provided with friction-enhancing surfaces (not shown) so as to improve the holding power of the clamp 11.

Turning now to FIGS. 4–10, there is illustrated a book mark according to a second embodiment of the present invention (wherein like elements are given the same numbers as those in FIGS. 1–3).

Figures 4, 5, 6, 7, 8, 9, 10:
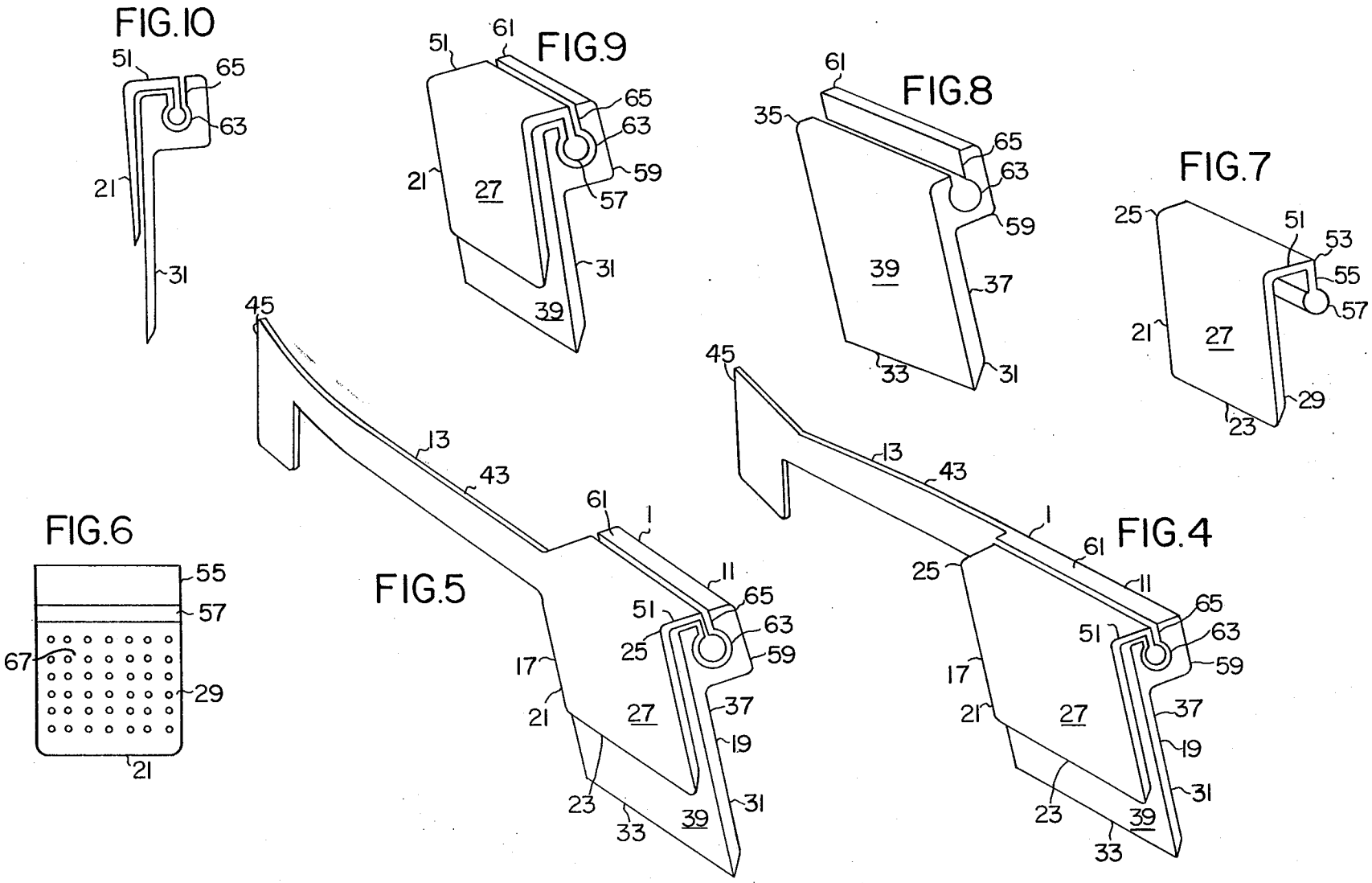
FIG. 4 is a perspective view of a book mark according to a second embodiment of the present invention.
FIG. 5 is a perspective view of another book mark according to the second embodiment of the present invention.
FIG. 6 is a plan view of one part of a two-part clamp mechanism of the second embodiment of the present invention.
FIG. 7 is a perspective view of one part of a two-part clamp mechanism of the second embodiment of the present invention.
FIG. 8 is a perspective view of the other part of a two-part clamp mechanism of the second embodiment of the present invention.
FIG. 9 is a perspective view illustrating assembly of the two part clamp mechanism of the second embodiment of the present invention.
FIG. 10 is an end view of the assembled two-part clamp mechanism illustrated in FIG. 9.

FIG. 4 illustrates a book mark 1 comprising a clamp 11 and a marker 13 integrally formed with the clamp and arranged to extend, in use, from the clamp generally outward of the spine of a book (not shown) for releasably marking a page in the book. As in the first embodiment, the clamp and the marker are formed of a flexible, resilient material.

The clamp 11 is a substantially U-shaped member having a first substantially vertical edge 17 and a second substantially vertical edge 19. The clamp comprises a substantially vertical first plate-like member 21 having a first end 23, a second end 25, a first face 27 and a second face 29, the second face 29 of the first plate-like member 21 being contactable with the book, the first plate-like member 21 having a first flange portion 51 extending substantially horizontally outward from the second face 29 proximate the second end 25, the first flange portion 51 having an outboard end 53, a second flange portion 55 extends substantially vertically downward from the outboard end 53 of the first flange portion 51, the second flange portion 55 being substantially parallel to the first plate-like member 21, the second flange portion having an expanded outer edge 57 of predetermined geometric shape; and a substantially vertical second plate-like member 31 forming the other of the legs of the U-shaped clamp 11, the second plate-like member 31 has a first end 33, a second end 35, a first face 37 and a second face 39, the second face 39 of the second plate-like member 31 being contactable with the book, the second plate-like member has a third flange portion 59 extending substantially horizontally outward from the first face 37 proximate the second end 35, the third flange portion 59 has an upper face 61, a bore 63 passing through the third flange portion 59 substantially parallel to the second plate-like member 31. The bore 63 has a predetermined geometric shape adapted to receive and slidingly engage the expanded outer edge 57 of the second flange portion 55, a slit 65 formed in the third flange portion 59 and coextensive therewith communicates the upper face 61 of the third flange portion 59 with the bore 63, the slit 65 being adapted to receive and slidingly engage the second flange portion 59. The first flange portion 51, the second flange portion 55, the third flange portion 59, the bore 63 and the slit 65 cooperate to interconnect the first plate-like member 21 and the second plate-like member 31 so that the second face 29 of the first plate-like member 21 faces and is disposed substantially parallel to the second face 39 of the second plate-like member 31 for resiliently engaging a portion of the book therebetween.

The marker 13 comprises an arm member 43 extending substantially horizontally from the first vertical edge 17 of the U-shaped clamp 11 proximate the first flange portion 51, the arm member having an outboard end 45 remote from the U-shaped clamp 11. A marker member 47 extends substantially vertically downward from the arm member 43 and the marker member 47 is contactable with a page of a book.

As with the case of the first embodiment of the present invention, the U-shaped clamp 11, the arm member 43 and the marker member 47 cooperate so that, when the U-shaped clamp 11 engages a portion of a book, with the second vertical edge 19 proximate the spine of the book, and the marker member 47 engages a page of the book, the arm member 43 yieldably urges the marker member 47 into engagement with a page of the book. As was also the case with the first embodiment of this invention, in the second embodiment of the invention, the first face 27 of the first plate-like member 21 and the first face 37 of the second plate-like member 31 may both be adapted to receive written indicia thereon. Again, as was also the case with the first embodiment of this invention, at least one of the second face 29 of the first plate-like member 21 and the second face 39 of the second plate-like member 31 may be provided with a friction enhancing surface 67 (as best seen in FIG. 6). Such a friction enhancing surface may include dimpling as shown in FIG. 6, an adhesive coating, or a mere roughening of the surface to enhance friction between the surface and a portion of the book.

As may best be seen in FIGS. 4 and 5, the marker 13 may be integrally formed with the first plate-like member 21 (FIG. 5) or it may be integrally formed with the second plate-like member 31 (FIG. 4).

Figure 11:
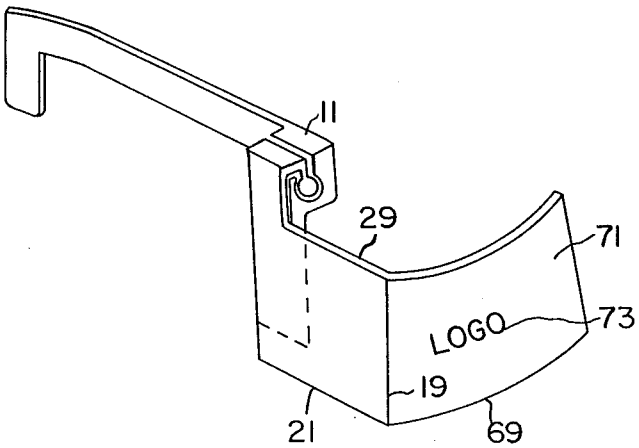
FIG. 11 is a perspective view of a further book mark according to the second embodiment of the present invention.
Figure 12:
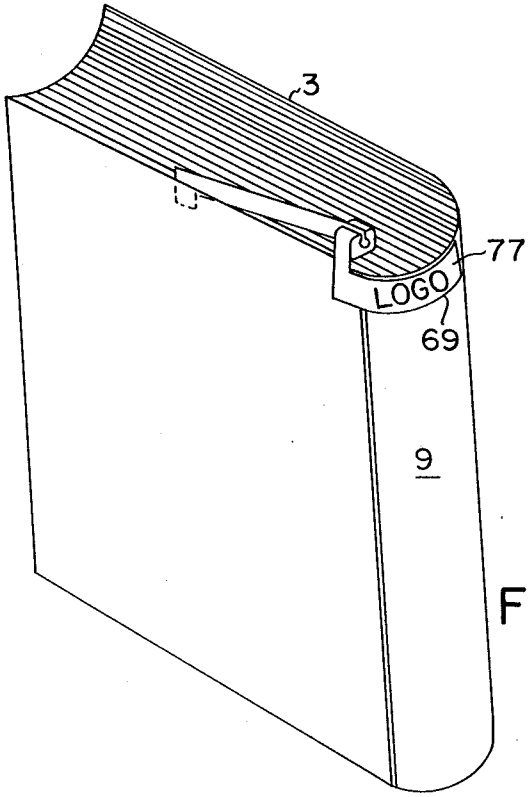
FIG. 12 is a perspective view of the book mark according to FIG. 11 in place on a book.

As may best be seen in FIGS. 11 and 12, a fourth flange portion 69 may extend outwardly from the second face 29 of the first plate-like member 21 proximate the second vertical edge 19 of the U-shaped clamp 11. The fourth flange portion 69 is adapted to cover a portion of the spine 9 of a book 3, the fourth flange portion 69 having a face 71 disposed outwardly of the spine 9 to receive written indicia 73 thereon. This version of the book mark allows the book to be shelved while still allowing the marker to be visible to the casual perusal of the shelved books.

Figure 13:
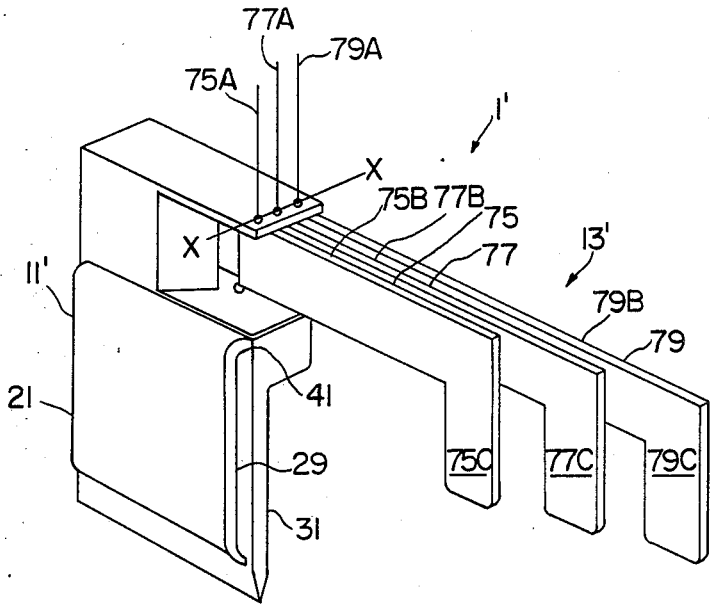
FIG. 13 is a perspective view of a book mark according to a third embodiment of the present invention.

FIG. 13 illustrates a further embodiment of the present invention, (wherein like parts are given like numbers) and comprises a book mark capable of simultaneously marking a plurality of pages in a book. In particular, the book mark 1' comprises a clamp 11' for releasable attachment to a book and a marker 13', operatively connected to the clamp 11, for releasably simultaneously marking a plurality of pages in a book.

As with the previous embodiments of this invention, the clamp 11 is formed of a flexible, resilient material. The clamp 11 is of a substantially U-shape and comprises a substantially vertical first plate-like member 21 forming one of the legs of the U; a substantially vertical second plate-like member 31 forming the other of the legs of the U, and a joining member 41 for conjoining the first plate-like member 21 with the second plate-like member 31 so that a portion of a book may be resiliently clamped between the two plate-like members. The marker 13'comprises a plurality of marker members 75, 77 and 79 (three marker members are illustrated, however, a greater or lesser number may also be incorporated) are pivotally connected to the clamp 11 for rotation about respective vertical axes **75*a*, 77*a* and 79*a*. Each of the markers 75, 77, 79 comprise a substantially horizontal arm 75*b*, 77*b* and 79*b* having one end pivotally connected to the clamp 11 for rotation about the respective vertical axis 75*a*, 77*a* and 79*a* and a marker member 75*c*, 77*c* and 79*c* extending substantially vertically downward from the other end of the arm member, the marker member being receivable between adjacent pages of a book to mark a given page. Preferably, the respective vertical axes 75*a*, 77*a* and 79*a*** intersect a straight line X—X disposed substantially perpendicular to the first plate-like member.

The substantially horizontal arm members **75*b*, 77*b* and 79*b* may be of the same or different lengths. In a preferred embodiment, the substantially horizontal arm members are each of a different length and are arranged so that the length of the arm members increases with the distance between the intersection of the respective vertical axis with the straight line X—X and the second face 29 of the first plate-like member 21**.

As was the case with the prior embodiments of this invention, the outboard faces of the first and second plate-like members may receive written indicia thereon.

This embodiment of the invention allows a plurality of pages to be marked simultaneously. Additionally, reference may be made to any one of the marked pages without disturbing the marker for other pages.

FIGS. 14–18 illustrate a fourth embodiment of the book mark according to the presently claimed invention. In particular, the book mark 90 comprises a clamp 91 for releasable attachment to a book, either by clamping one of the covers therein or a plurality of pages therein; and a marker portion 92 which is integrally formed with the clamp 91 and arranged to extend, in use, from the clamp 91 generally outward of the spine 93 of a book. The clamp 91 and the marker portion 92 may be formed of a molded, flexible, resilient material. The clamp 91 is a substantially U-shaped member having a first substantially vertical edge 94 and a second substantially vertical edge 95. The marker portion 92 comprises an arm member 96 which is hingedly attached to and extends substantially horizontally from the first vertical edge 94 of the clamp 91. The arm member has an outboard end 97 remote from the clamp 91, and the arm member 96 is hingedly moveable from a first position wherein it extends substantially in a common plane with the clamp 91 (as shown in FIG. 15) to a second position where it is substantially folded across the clamp (as shown in FIG. 14). The hinge 98 may be formed as a slightly thinned portion of the book mark body so as to allow bending in the aforementioned manner, even though the resilience of the material will generally yieldably urge the arm member 96 into the position shown in FIG. 15. A marker member 99 is fixed to the outboard end 97 of the arm member 96 and extends substantially vertically downwardly from the arm member. The marker member is engageable of a page 100 of a book.

A releasable locking mechanism 101, 102 is provided for releasably locking the arm member 96 in the second position (as shown in FIG. 14). As previously noted, the releasable locking mechanism comprises a first locking element 101 on the arm member 96 and a second locking element 102 on the clamp 91. The first and second locking elements are releasably engageable of one another. In the preferred embodiment illustrated in FIGS. 14 and 15, the first locking element 101 comprises an aperture formed in the arm member 96 and the second locking element 102 comprises a pin extending outwardly from the clamp 91. The pin is force fittingly receivable in the aperture.

Figure 17:
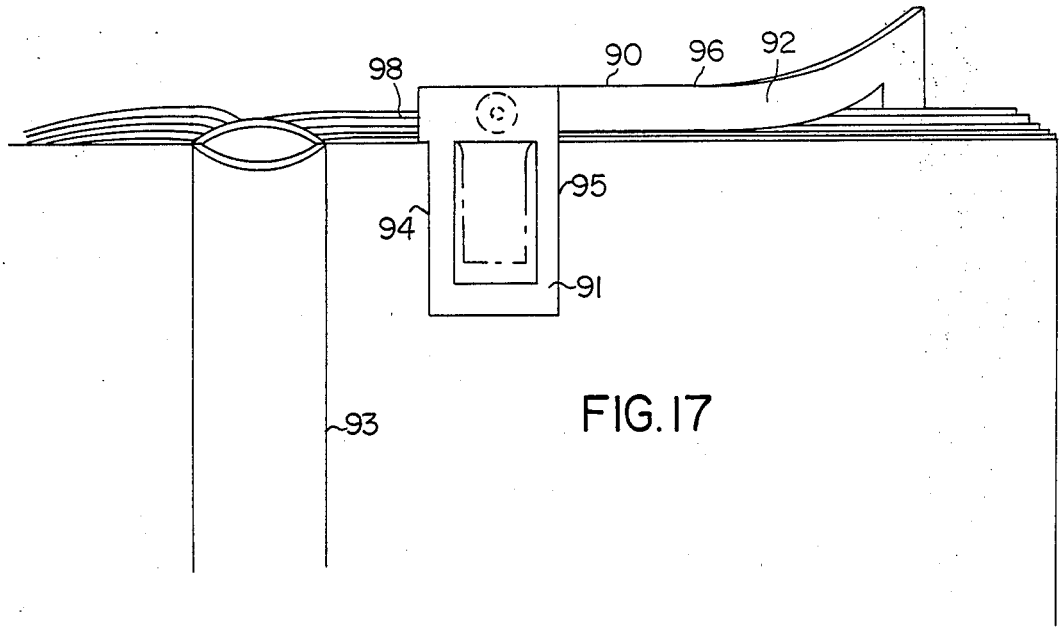
FIG. 17 is a rear view of a book mark according to a fourth embodiment of the present invention, "locked" in a second position, in place on a book.
Figure 18:
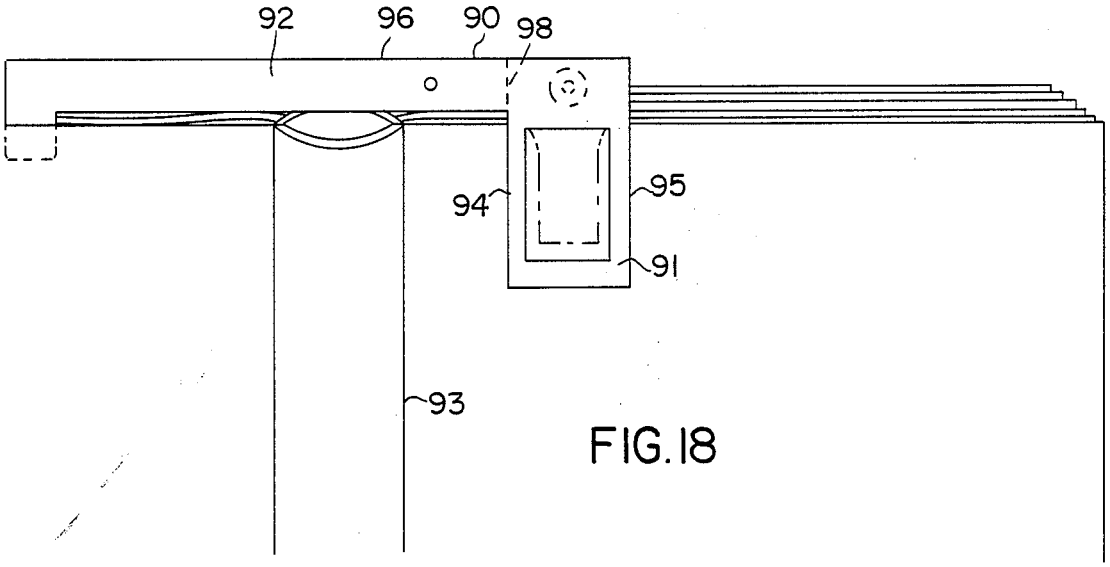
FIG. 18 is a rear view of a book mark according to a fourth embodiment of the present invention, in a first position, in place on a book.

Thus, the clamp 91, the arm member 96, the marker member 99 and the releasable locking mechanism 101, 102 cooperate so that, when the arm member 96 is locked in the second position and the clamp 91 engages a portion of a book, with the first vertical edge 94 proximate the spine 93 of the book, and the marker member 99 engaging a page of the book, the arm member 96 yieldably urges the marker member into engagement with the page of the book (as shown in FIGS. 16 and 17); and when the arm member 96 is released from the second position and the clamp 91 engages a portion of the book, with the first vertical edge 94 proximate the spine of the book 93, and the marker member 99 engages a page of the book, the arm member 96 may freely move between the first and second positions to allow browsing through the pages of the book while the marker member 99 remains in contact with the page (as shown in FIG. 18, wherein the arm member 96 is in the first position).

While the present invention has been illustrated and discussed with respect to the book mark being attachable to a cover of a hard-bound volume, it is also within the scope of the present invention for the book mark to be engaged with the cover of a soft-bound volume, or to be merely engaged with a number of pages of a bound or non-bound manuscript.

As will be further apparent from the above description of the present invention, various parts utilized in the assembly of the present book marks may be color coded so as to identify either a user of the book mark or the subject matter which the book mark indicates, over and above any indications provided by written indicia placed on the book marks.

What is claimed is:

1. A book mark for use in combination with a book having a front cover, a back cover and a spine therebetween, said book mark comprising:

a clamp means for releasable attachment to a book;

a marker means, integrally formed with said clamp means and arranged to extend in use from said clamp means generally outward a said spine of said book, for releasably marking a page in said book;

said clamp means and said marker means formed of a flexible, resilient material;

wherein said clamp means is a substantially U-shaped member, having a first substantially vertical edge and a second substantially vertical edge, comprising:

a substantially vertical first plate-like member forming one of the legs of the U, said first plate-like member having a first end, a second end, a first face and a second face, said second face of said first plate-like member contacting engageable of said book, said first plate-like member having a first flange portion extending substantially horizontally outward from said second face proximate said second end, said first flange portion having an outboard end, a second flange portion extending substantially vertically downward from said outboard end of said first flange portion, said second flange portion substantially parallel to said first plate-like member, said second flange portion having an expanded outer edge of predetermined geometric shape;

a substantially vertical second plate-like member forming the other of the legs of the U, said second plate-like member having a first end, a second end, a first face and a second face, said second face of said second plate-like member contactingly engageable of said book; said second plate-like member having a third flange portion extending substantially horizontally outward from said first face proximate said second end, said third flange portion having an upper face, a bore passing through said third flange portion substantially parallel to said second plate-like member, said bore having a predetermined geometric shape adapted to receive and slidingly engage said expanded outer edge of said second flange portion, a slit formed in said third flange portion and coextensive therewith communicating said upper face of said third flange portion with said bore, said slit adapted to receive and slidingly engage said second flange portion;

said first flange portion, said second flange portion, said third flange portion, said bore and said slit cooperating to interconnect said first plate-like member and said second plate-like member so that said second face of said first plate-like member faces and is disposed substantially parallel to said second face of said second plate-like member for resiliently engaging a portion of said book therebetween;

and wherein said marker means comprises:

an arm member extending substantially horizontally from said first vertical edge of said U-shaped member proximate said first flange portion, said arm member having an outboard end remote from said U-shape member;

a marker member extending substantially vertically downward from said arm member, said marker member contactingly engageable of a page of said book;

and wherein said U-shaped member, said arm member and said marker member cooperate so that, when said U-shaped member engages a portion of said book, with said second vertical edge proximate said spine of said book, and said marker member engages a page of said book, said arm member yieldably urges said marker member into engagement with said page of said book.

2. The book mark according to claim 1, wherein said first face of said first plate-like member is adapted to receive written indicia thereon.

3. The book mark according to claim 1, wherein said first face of said second plate-like member is adapted to receive written indicia thereon.

4. The book mark according to claim 1, wherein at least one of said second face of said first plate-like member and said second face of said second plate-like member is provided with a friction-enhancing surface.

5. The book mark according to claim 1, wherein said marker means is integrally formed with said first plate-like member.

6. The book mark according to claim 1, wherein said marker means is integrally formed with said second plate-like member.

7. The book mark according to claim 6, wherein a substantially vertical fourth flange portion extends outwardly from said second face of said first plate-like member proximate said second vertical edge of said U-shaped member, said fourth flange portion adapted to cover a portion of the spine of said book, said fourth flange portion having a face disposed outwardly of said spine adapted to receive written indicia thereon.

8. A book mark for use in combination with a book having a front cover, a rear cover and a spine, said book mark comprising:

a clamp means for releasable attachment to said book;

a marker means, operatively connected to said clamp means for releasably simultaneously marking a plurality of pages in said book;

said clamp means formed of a flexible, resilient material;

wherein said clamp means is a substantially U-shaped member comprising:

a substantially vertical first plate-like member forming one of the legs of the U, said first plate-like member having a first end, a second end, a first face and a second face, said second face of said first plate-like member contactingly engageable of said book;

a substantially vertical second plate-like member forming the other of the legs of the U, said second plate-like member having a first end, a second end, a first face and a second face, said second face of said second plate-like member contactingly engageable of said book;

joining means for conjoining said second end of said first plate-like member with said second end of said second plate-like member so that said second face of said first platelike member faces and is disposed substantially parallel to said second face of said second plate-like member for resiliently engaging a portion of said book therebetween;

and wherein said marker means comprises:

a plurality of markers pivotally connected to said clamp means for rotation about respective vertical axes, each of said markers comprising:

a substantially horizontal arm member having a first end and a second end, said first end pivotally connected to said clamp means for rotation about a vertical axis, and a marker member extending substantially vertically downward from said second end of said arm member, said marker member being receivable between adjacent pages of said book to mark a page.

9. The book mark according to claim 8, wherein said respective vertical axes of said plurality of markers intersect a straight line disposed substantially perpendicular to said second face of said first plate-like member.

10. The book mark according to claim 8, wherein said substantially horizontal arm members are each of a different length.

11. The book mark according to claim 9, wherein said substantially horizontal arm members are each of a different length and are arranged so that the length of said arm members increases with the distance between the intersection of said respective vertical axis with said straight line and said second face of said first plate-like member.

12. The book mark according to claim 8, wherein said first face of said first plate-like member is adapted to receive written indicia thereon.

13. The book mark according to claim 8, wherein said first face of said second plate-like member is adapted to receive written indicia thereon.

14. A book mark for use in combination with a book having a front cover, a back cover and a spine therebetween, said book mark comprising:

a clamp means for releasable attachment to a book;

a marker means, integrally formed with said clamp means and arranged to extend, in use, from said clamp means generally outward of said spine, for releasably marking a page in said book;

said clamp means and said marker means formed of a molded, flexible, resilient material;

wherein said clamp means is a substantially U-shaped member, having a first substantially vertical edge and a second substantially vertical edge;

and wherein said marker means comprises:

an arm member hingedly attached to and extending substantially horizontally from said first vertical edge of said U-shaped member, said arm member having an outboard end remote from said U-shaped member, said arm member hingedly movable from a first position wherein it extends substantially in a common plane with said U-shaped member to a second position wherein it is substantially folded across said U-shaped member, a marker member fixed to said outboard end of said arm member and extending substantially vertically downwardly from said arm member, said marker member contactingly engageable of a page of said book;

releasable locking means for releasably locking said arm member in said second position;

wherein said U-shaped member, said arm member, said marker member and said releasable locking means cooperate so that, when said arm member is locked in said second position and said U-shaped member engages a portion of said book, with said first vertical edge proximate said spine of said book, and said marker member engages a page of said book, said arm member yieldably urges said marker member into engagement with said page of said book, and when said arm member is released from said second position and said U-shaped member engages a portion of said book, with said first vertical edge proximate said spine of said book, and said marker member engages a page of said book, said arm member may freely move between said first and second positions to allow browsing through the pages of said book while said marker member remains in contact with said page.

15. The book mark according to claim 14, wherein said releasable locking means comprises a first locking element on said arm member and a second locking element on said U-shaped member, said first and second locking elements releasably engageable of one another.

16. The book mark according to claim 15, wherein said first locking element comprises an aperture formed in said arm member and said second locking element comprises a pin extending from said U-shaped member, said pin force fittingly receivable in said aperture.

* * * * *